US007350453B1

(12) United States Patent
Bailey et al.

(10) Patent No.: US 7,350,453 B1
(45) Date of Patent: Apr. 1, 2008

(54) HYDRAULIC CYLINDER WITH ROTATABLE GLAND

(75) Inventors: Kevin D. Bailey, Loudon, TN (US); Casey L. Coykendall, Knoxville, TN (US)

(73) Assignee: Bailey International Corporation, Knoxville, TN (US)

( * ) Notice: Subject to any disclaimer, the term of this patent is extended or adjusted under 35 U.S.C. 154(b) by 0 days.

(21) Appl. No.: 11/230,778

(22) Filed: Sep. 20, 2005

(51) Int. Cl.
*F01B 29/08* (2006.01)

(52) U.S. Cl. ..... 92/128; 92/169.1

(58) Field of Classification Search ..... 92/169.1, 92/128

See application file for complete search history.

(56) References Cited

U.S. PATENT DOCUMENTS

| | | | | |
|---|---|---|---|---|
| 1,464,386 | A * | 8/1923 | Ingram | 29/436 |
| 2,645,513 | A * | 7/1953 | Sterrett | 292/256.6 |
| 2,677,933 | A | 5/1954 | Hopkinson | |
| 3,650,182 | A | 3/1972 | Phillips | |
| 3,881,401 | A * | 5/1975 | Bimba | 92/169.1 |
| 4,192,225 | A * | 3/1980 | Moyer | 92/169.1 |
| 4,357,858 | A | 11/1982 | Wedman | |
| 4,771,678 | A | 9/1988 | Walker | |
| 4,878,419 | A | 11/1989 | Vick | |
| 5,172,625 | A | 12/1992 | Latham | |
| 5,245,911 | A * | 9/1993 | Yuda | 92/169.1 |
| 5,400,695 | A | 3/1995 | Walker | |
| 5,487,326 | A | 1/1996 | Owens | |
| 6,101,922 | A | 8/2000 | King | |
| 6,112,640 | A | 9/2000 | King | |
| 6,837,144 | B2 | 1/2005 | Herwig | |
| 2002/0166447 | A1 | 11/2002 | Thomas et al. | |

FOREIGN PATENT DOCUMENTS

| | | |
|---|---|---|
| EP | 1 566 552 | 8/2005 |
| WO | WO 03/064864 | 8/2003 |

* cited by examiner

*Primary Examiner*—Igor Kershteyn
(74) *Attorney, Agent, or Firm*—Luedeka, Neely & Graham, PC

(57) ABSTRACT

A hydraulic cylinder having a gland that is rotatable relative to the cylinder tube, the pivotal connection provided by a pair of aligned annular grooves on the gland and the cylinder tube, a key slot located through the cylinder tube, and a key positionable through the key slot to be located within the annular grooves to rotatably attach the gland to the cylinder tube. The key includes one end configured to engage the gland for facilitating installation and another end configured in a wedge shape to facilitate removal of the key.

4 Claims, 1 Drawing Sheet

HYDRAULIC CYLINDER WITH ROTATABLE GLAND

FIELD OF THE INVENTION

This invention relates generally to hydraulic cylinders. More particularly, this invention relates to a hydraulic cylinder having a gland that can be rotated 360 degrees and which is easily assembled and disassembled.

BACKGROUND AND SUMMARY OF THE INVENTION

Improvement is desired in the construction of hydraulic cylinders to enable flexibility in the positioning of the port opening. In this regard, the disclosure relates to a hydraulic cylinder construction which permits the gland of the hydraulic cylinder on which a port is provided to be rotated 360 degrees. This is advantageous to provide users flexibility to position the port opening as desired. The described structure also facilitates assembly and disassembly of the cylinder.

In a preferred embodiment, the hydraulic cylinder includes a gland that is rotatable relative to the cylinder tube, the pivotal connection provided by a pair of aligned annular grooves on the gland and the cylinder tube. A key slot is located through the cylinder tube, and a key is positionable through the key slot to be located within the annular grooves to rotatably attach the gland to the cylinder tube. The key has one end configured to engage the gland for facilitating installation and another end configured in a wedge shape to facilitate removal of the key.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
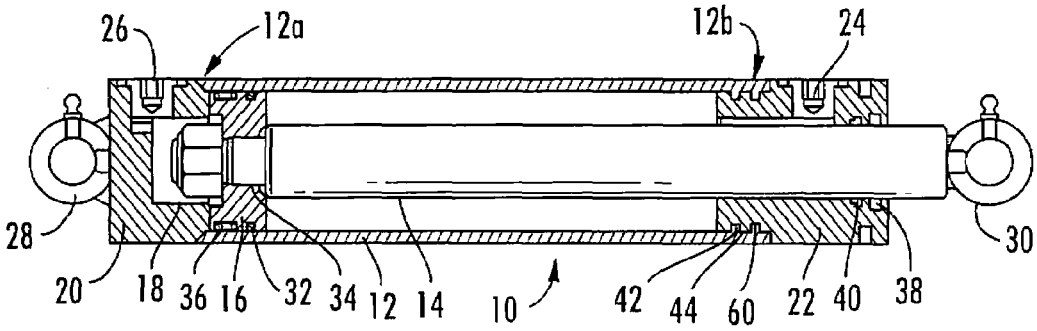
FIG. 1 is a cross-sectional side view of a hydraulic cylinder according to a preferred embodiment.
Figure 2:
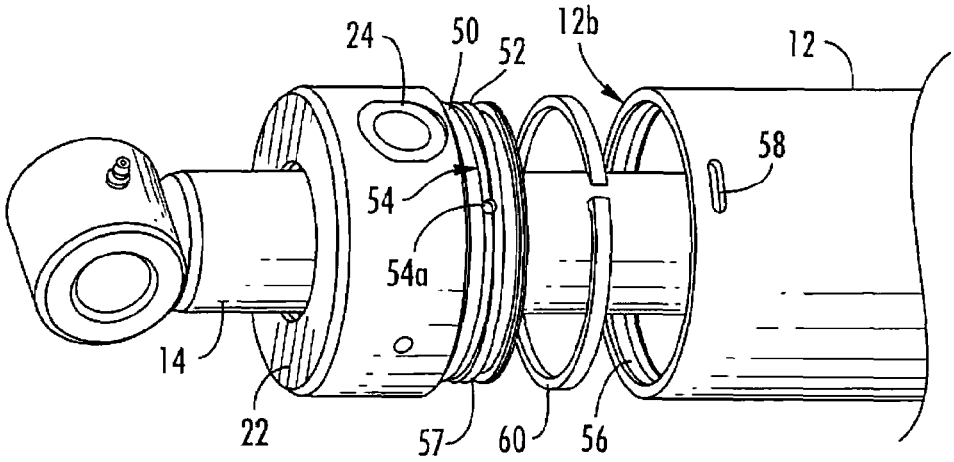
FIG. 2 is an exploded perspective view of a gland end of the cylinder of FIG. 1.

With reference to FIGS. 1 and 2, there is shown a preferred embodiment of a hydraulic cylinder 10. The cylinder 10 includes a cylinder tube 12 in which a piston rod 14 having a piston 16 mounted thereto by a piston nut 18 is positioned for axial back and forth motion during operation of the cylinder 10.

A base 20 is fixedly attached to one end of the tube 12 to define a closed end 12*a*. A gland 22 is located at opposite open end 12*b* of the tube 12 to seal the open end of the tube 12 and allow the piston rod 14 to move in a back and forth motion therethrough. The gland 22 includes a port 24 for attachment of a hydraulic line for communicating hydraulic fluid into and out of the cylinder 10 during operation thereof. The base 20 may also include a similar port 26. The ports 24 and 26 are preferably recessed into the gland 22 and the base 24 so as to not extend outwardly therefrom. A clevis 28 is attached to the base 20 and a clevis 30 is attached to the free end of the piston rod 14, it being understood that the devises enable attachment of the cylinder 10 to equipment with which it is to be used.

Other components of the cylinder 10 include various seals and o-rings to maintain hydraulic fluid within the cylinder 10. For example, the piston 16 may include a piston seal 32, o-ring 34, and a piston wear ring 36. The gland 22 preferably includes wiper seal 38, a rod seal 40, an o-ring 42, and a back-up ring 44.

The configuration of the gland 22 and the open end 12*b* of the tube 12 cooperate to enable the gland 22 to rotate through 360 degrees relative to the tube 12. In a preferred embodiment, this may be accomplished by configuring the portion of the gland 22 which is inserted into the open end 12*b* of the tube 12, and the interior sidewall of the open end 12*b* to provide a keyed joint. For example, the portion of the gland 22 which is inserted into the open end 12*b* of the tube 12 defines a pair if spaced apart and raised annular ribs 50 and 52, between which is defined an annular groove 54. A correspondingly positioned and configured groove 56 is defined on the inner sidewall of the open end 12*b*. As will be noticed, an aperture 54*a* is defined along the groove 56 for purposes explained below. An additional groove 57 is shown on the gland 22, but this groove 57 is not related to the rotatable structure of the gland, but is provided for receiving the o-ring 42 and the back-up ring 44. A key slot 58 is defined through the sidewall of the open end 12*b* and axially aligned with the groove 56 to provide access to the groove 54 of the gland 22 when the gland 22 is installed in the tube 12 for insertion and removal of a key 60 which is utilized to rotatably attach the gland 22 to the tube 12.

Figure 3:
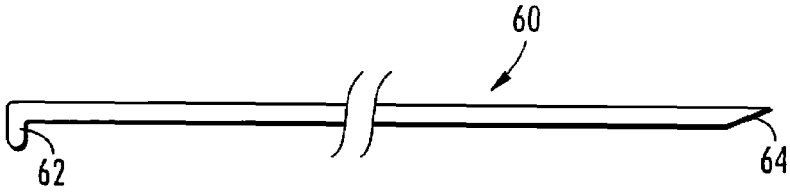
FIG. 3 is a side view of a key used to attach a gland of the cylinder of FIG. 1.

With reference to FIG. 3, the key 60 is preferably an elongate member made of spring steel, preferably from square-cross-sectioned spring steel. The key 60 is preferably configured to have a length substantially corresponding to but slightly less than the circumference of the groove 54 so that the ends of the key are spaced slightly apart when the key 60 is installed. In addition, one end of the key 60 is preferably formed into a right angle end 62 and the opposite end is preferably tapered to define a wedge end 64. The right angle end 62 is configured for frictionally engaging the aperture 54*a* of the groove 54 to facilitate installation of the key 60. The wedge end 64 is provided to facilitate removal of the key 60 and preferably is angled from about 10 to about 20 degrees, most preferably about 16 degrees.

To install the gland 22 into the open end 12*b* of the tube 12, the gland 22 is inserted into the open end 12*b*, it being understood that the end of the gland 22 inserted into the open end is configured for a close but movable interference fit. When the gland 22 is fully inserted into the open end 12*b*, the grooves 54 and 56 overlie one another. The gland 22 is preferably rotated relative to the tube 12 so that the aperture 54*a* of the groove 54 is visible through the slot 58. The right angle end 62 of the key 60 is inserted through the slot 58 and force exerted to engage the right angle end 62 into the aperture 54*a*. The gland 22 is then rotated relative to the tube 12 to pull the remaining length of the key 60 through the slot 58 so as to become installed within the grooves 54 and 56. In the installed orientation, the key 60 maintains the relative longitudinal positions of the gland 22 and the tube 12, but enables relative and substantially free rotary motion so as to permit the gland 22 to be rotated easily relative to the tube 12. In this regard, it is preferred that the tolerances are adjusted so that a force of about 100 ft-lbs or less, should be applied to rotate the gland 22 relative to the tube 12. This additional pressure helps the gland maintain a desired position, but still be easily rotated.

To disassemble the gland 22 from the tube 12, the gland 22 is rotated to locate the wedge end 64 of the key 60 below the slot 58. In this regard, the wedge end 64 is positioned adjacent the slot 58 so as to taper away from the slot so as to provide an engagement surface for engaging a removal instrument to facilitate removal of the key upwardly and out of the slot for disassembly of the hydraulic cylinder. Examples of preferred removal tools include a pick or the like which may be inserted through the slot 58 to contact the wedge end 64 to urge the wedge end 64 out through the slot 58. The end 64 may then be grasped and the gland 22 rotated to pull the remainder of the key 60 through the slot 58.

It will be further understood that the base 20 may be rotatably attached to the tube 12 in a similar manner using a key like the key 60.

As will be appreciated, the described structure provides a hydraulic cylinder having a gland end that is rotatable relative to the tube of the cylinder and which is easily assembled and disassembled.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A hydraulic cylinder, comprising:

a cylinder tube having a closed end and an opposite open end, the opposite open end defining a first annular groove on a sidewall thereof and a slot defined through the sidewall and a portion of the first annular groove;

a piston rod having a piston mounted thereto and positioned within the cylinder tube for axial back and forth motion during operation of the hydraulic cylinder;

a gland located in the open end of the cylinder tube to seal the open end of the cylinder tube and allow the piston rod to move in a back and forth motion therethrough, the gland defining a second annular groove thereon and located so as to substantially overly the first annular groove and the slot, and an elongate and flexible key inserted through the slot and positioned within the first and second annular grooves to rotatably attach the gland to the tube and maintain a desired relative position of the gland relative to the tube by maintaining the relative longitudinal positions of the gland and the cylinder tube while maintaining the relative rotary positions of the gland and the tube in the absence of a turning force below a predetermined level but enabling relative rotary motion when a turning force above the predetermined level is applied so as to permit the gland to be rotated relative to the cylinder tube, wherein the second annular groove includes a key aperture defined thereon and the key includes a first end configured to substantially engage the key aperture to facilitate installation of the key, and wherein the key includes a second wedge shaped end positioned adjacent the slot so as to taper away from the slot at an angle of from about 10 to about 20 degrees and provide an engagement surface for engaging a removal instrument to facilitate removal of the key upwardly and out of the slot for disassembly of the hydraulic cylinder.

2. The hydraulic cylinder of claim 1, wherein the key is made of spring steel.

3. The hydraulic cylinder of claim 1, wherein the gland further includes a hydraulic fluid port thereon for communicating hydraulic fluid to an interior portion of the cylinder tube.

4. The hydraulic cylinder of claim 1, wherein the closed end comprises a base rotatably attached to the tube by positioning a second key through a second slot into third and fourth aligned grooves defined on the tube and the base, wherein the second key includes a wedge shaped end which may be positioned adjacent the second slot so as to taper away from the second slot so as to provide an engagement surface for engaging a removal instrument to facilitate removal of the second key upwardly and out of the second slot for disassembly of the hydraulic cylinder.

* * * * *